United States Patent [19]

Harbulak et al.

[11] 4,042,470

[45] Aug. 16, 1977

[54] BRASS PLATING

[75] Inventors: Edward P. Harbulak, Allen Park; Ronald J. Lash, Warren, both of Mich.

[73] Assignee: M&T Chemicals Inc., Greenwich, Conn.

[21] Appl. No.: 729,024

[22] Filed: Oct. 4, 1976

[51] Int. Cl.[2] ..... C25D 3/56; C25D 3/58

[52] U.S. Cl. ..... 204/44

[58] Field of Search ..... 204/44, 123

[56] References Cited

U.S. PATENT DOCUMENTS 3,930,965 1/1976 Abbott ..... 204/44

OTHER PUBLICATIONS

Abner Brenner, "Electrodeposition of Alloys," vol. I, pp. 422–438, (1963).

*Primary Examiner*—G. L. Kaplan

*Attorney, Agent, or Firm*—Kenneth G. Wheeless; Robert P. Auber; Robert Spector

[57] ABSTRACT

This invention relates to a composition and process for electrodepositing semi-bright to bright brass from an aqueous alkaline cyanide electroplating solution containing at least one copper compound providing copper ions, at least one zinc compound providing zinc ions, and as a cooperating additive 0.1 to 10 grams per liter of at least one compound having the following generalized structural formula:

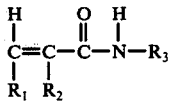

where $R_1$ and $R_2$ are separately hydrogen, an alkyl group such as methyl, ethyl, isopropyl, etc., or a hydroxy alkyl group such as hydroxy methyl, hydroxy ethyl, etc. and $R_3$ is hydrogen or a straight or branched chain alkyl sulfonic or carboxylic acid of from one to ten carbon atoms, or salts thereof, or a straight or branched chain hydroxy alkyl group of from one to five carbon atoms.

8 Claims, No Drawings

BRASS PLATING

This invention relates to the electrodeposition of brass, to brass alloy electroplating baths and to methods of electroplating brass. More specifically, this relates to an additive for the electrodeposition of semi-bright to bright uniform brass deposits.

BACKGROUND OF THE INVENTION

Alkaline cyanide brass electroplating baths giving about 52 to 56 percent copper in the deposit are employed as a partial or complete substitute for semi-bright nickel deposits in duplex nickel, chromium plating systems [see Plating, 58, Page 1094 (1971)]. In order to obtain a fine-grained, lustrous, semi-bright to bright brass deposit which can be subsequently further plated with bright nickel and chromium, it is necessary to introduce certain organic additives into the plating bath. While these additives, e.g., condensation products of naphthalene sulfonic acids with formaldehyde as in U.S. Pat. No. 3,296,101, give smooth, lustrous deposits as required, the brass deposit itself is internally weakened, so that its internal cohesive or bond strength is easily overcome and, when a subsequent nickel deposit is plated over the brass deposit, the intermetallic bonds of the brass metal are easily ruptured causing peeling of the overlying deposit. This is an undesirable condition from both an appearance and protective standpoint since there is no protection from corrosion where the overlying deposit has peeled away.

In other cases (e.g., U.S. Pat. No. 3,620,937) although brass deposits of sufficient internal cohesive strength are obtained, the low current density areas of the deposit tend to be dull and grainy which in turn results in poor appearance when subsequently bright nickel plated.

DETAILED DESCRIPTION

This invention relates to useful additives for cyanide brass electroplating baths which, when used in concentration of about 0.1 to 10 g/l (preferably 0.5 to 2 g/l), results in brass deposits that are fine grained, semi-bright to bright over a wide current density range, including the low current density areas, and further the deposits have superior internal cohesive or bond strength so that peeling of subsequent deposits does not occur, nor will the brass deposits peel from themselves, thus the brass deposits do not have the deficiencies mentioned previously.

Thus, this invention relates to a composition and process for electrodepositing semi-bright to bright brass from an aqueous alkaline cyanide electroplating solution containing at least one copper compound providing copper ions, at least one zinc compound providing zinc ions, and as a cooperating additive, 0.1 to 10 grams per liter of at least one compound having the following generalized structural formula:

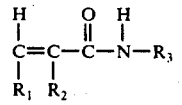

where $R_1$ and $R_2$ are each independently selected from the group consisting of hydrogen, alkyl groups of from one to ten carbon atoms and hydroxy alkyl groups of from one to ten carbon atoms and $R_3$ is hydrogen or a straight or branched chain alkyl sulfonic or carboxylic acid of from one to ten carbon atoms, or salts thereof, or a straight or branched chain hydroxy alkyl group of from one to five carbon atoms.

Examples of typical compounds described by the above generalized structure include:

acrylamide

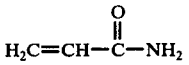

methacrylamide

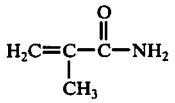

2-acrylamido-2-methylpropanesulfonic acid

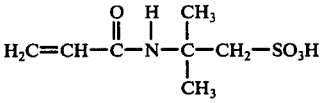

The practice of this invention is carried out using an alkaline cyanide brass plating bath in which the concentrations of copper, of zinc, and of cyanide are within the limits for brass electroplating operations. Such plating baths usually contain from 5 to 100 grams per liter of copper, from 5 to 70 grams per liter of zinc, and from 20 to 200 grams per liter of alkali metal cyanide.

Practice of this invention results in a semi-bright to bright deposit over a wide current density range. The novel additive of this invention also eliminates the problem of maintaining the alloy composition within narrow limits to preserve uniformity and coverage.

Copper may be added as cuprous cyanide and zinc as zinc cyanide.

The cooperating novel additives of this invention are present in the brass plating solution in a concentration of from 0.1 gram per liter to 10 grams per liter, preferably from 0.5 gram per liter to 2.0 grams per liter.

The basis metals which may be electroplated in accordance with the process of this invention may include ferrous metals, such as steel, iron, etc.; zinc and its alloys including zinc-base die-cast articles; nickel, including nickel alloys with other metals such as cobalt or iron; aluminum, including its alloys, after suitable pretreatment, etc.

The plating conditions for electrodeposition from the aforementioned baths may, for example, include temperatures of 10° C. - 60° C. (preferably 20° C - 40° C.) and a cathode current density of 0.1 - 50.0 amperes per square decimeter (asd.).

Typical effective average current densities range from 1 ampere per square decimeter to 10 amperes per square decimeter.

The following examples are set forth for the purpose of providing those skilled in the art with a better understanding of this invention, and the invention is not to be construed as limited to such examples.

EXAMPLE 1

A brass bath was prepared having the following make-up composition:

| | g/l |
|---|---|
| Copper (I) Cyanide | 25 |
| Zinc Oxide | 19 |
| Sodium Cyanide | 73 |

-continued

| | |
|---|---|
| Sodium Hydroxide | 20 |

A Hull cell test was run under the following conditions:

| | |
|---|---|
| Solution Volume | 250 ml |
| Agitation | Air on Anode |
| Anode | Copper, Zinc Alloy |
| Cathode | Polished Steel |
| Temperature | 24° C |
| Current | 2 amperes |
| Time | 15 minutes |

The resulting deposit had poor reflectivity in the current density range below 9 asd with a coarse-grained, gray band in the 0.2 to 0.8 asd region of the panel.

EXAMPLE 2

Example 1 was repeated with the addition of 1 gram per liter of 2-acrylamido-2-methylpropanesulfonic acid. The resulting brass deposit was semi-bright and uniform in the current density range of 1.2 asd to 9 asd. Below 1.2 asd the deposit changed from a brass color to reddish-copper color but was entirely reflective and free from coarse-grained bands. The entire deposit at all current densities was easily covered with 8 microns of a typical bright nickel, which adhered well and could not be caused to separate or peel from the underlying brass.

EXAMPLE 3

Example 1 was repeated with the addition of 1 gram per liter of acrylamide. The resulting deposit was fully bright throughout the current density range of 0.1–8 asd with a change of color from "pink" to silvery-gray in the region less than 0.2 asd. The brass deposit covered well with 8 microns of bright nickel which adhered strongly and could not be caused to separate or peel.

EXAMPLE 4

Results similar to those obtained in Example 3 were also obtained using 1 g/l methacrylamide in place of acrylamide using the bath and test conditions of Example 1.

EXAMPLE 5

A brass bath was prepared having the following make-up composition:

| | |
|---|---|
| 40 | g/l Copper Cyanide |
| 19.5 | g/l Zinc Oxide |
| 20 | g/l Sodium Hydroxide |
| 89.5 | g/l Sodium Cyanide |

Hull cell test panels were run under the same conditions as listed in Example 1. The resulting yellow brass deposit was dull at current densities below 1.2 asd and possessed little reflectivity at current densities greater than 1.2 asd.

EXAMPLE 6

The test of Example 5 was repeated with the addition of 1 g/l acrylamide. The resulting yellow brass deposit was fully bright throughout the current density range of 0.1–8 asd. Both nickel coverage and adhesion of the nickel to the brass as well as the cohesive strength of the brass itself were excellent.

EXAMPLE 7

A brass bath was prepared having the following make-up composition:

| | |
|---|---|
| 14.8 | g/l Copper Cyanide |
| 28 | g/l Zinc Oxide |
| 28 | g/l Sodium Hydroxide |
| 61.8 | g/l Sodium Cyanide |

Hull cell test panels were run under the same conditions as listed in Example 1. The resulting white brass deposit was non-uniform and possessed poor reflectivity over the entire current density range of the test panel.

EXAMPLE 8

The test of Example 7 was repeated with the addition of 1 g/l acrylamide. The resulting deposit was fully bright throughout the current density range of 0.1 to 8 asd.

Although this invention has been illustrated by reference to specific embodiments, modifications thereof which are clearly within the scope of the invention will be apparent to those skilled in the art.

What is claimed is:

1. A process for electrodepositing semi-bright to bright brass comprising passing current from an anode to a basis metal cathode through an aqueous alkaline cyanide electroplating solution containing at least one copper compound providing copper ions, at least one zinc compound providing zinc ions, and as a cooperating additive 0.1 to 10 grams per liter of at least one compound exhibiting the following generalized structural formula:

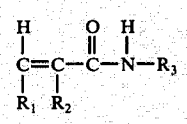

where $R_1$ and $R_2$ are each independently selected from the group consisting of hydrogen, alkyl groups exhibiting from one to ten carbon atoms and hydroxy alkyl groups exhibiting from one to ten carbon atoms and $R_3$ is hydrogen or a straight or branched chain alkyl sulfonic or carboxylic acid of from one to ten carbon atoms, or salts thereof, or a straight or branched chain hydroxy alkyl group of from one to five carbon atoms.

2. The process of claim 1 wherein said additive is acrylamide.

3. The process of claim 1 wherein said additive is methacrylamide.

4. The process of claim 1 wherein said additive is 2-acrylamido-2-methylpropanesulfonic acid.

5. A composition for electrodepositing semi-bright to bright brass which comprises an aqueous alkaline cyanide brass electroplating bath containing at least one copper compound providing copper ions, at least one zinc compound providing zinc ions, and as a cooperating additive 0.1 to 10 grams per liter of at least one compound exhibiting the following generalized structural formula:

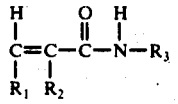

where $R_1$ and $R_2$ are each independently selected from the group consisting of hydrogen, alkyl groups exhibiting from one to ten carbon atoms and hydroxy alkyl groups exhibiting from one to ten carbon atoms and $R_3$ is hydrogen or a straight or branched chain alkyl sulfonic or carboxylic acid from one to ten carbon atoms, or salts thereof, or a straight or branched chain hydroxy alkyl group of from one to five carbon atoms.

6. The composition of claim 5 wherein said additive is acrylamide.

7. The composition of claim 5 wherein said additive is methacrylamide.

8. The composition of claim 5 wherein said additive is 2-acrylamido-2-methylpropanesulfonic acid.

* * * * *